US008979719B2

(12) United States Patent
Januszek

(10) Patent No.: US 8,979,719 B2
(45) Date of Patent: Mar. 17, 2015

(54) KETTLEBELL AND METHOD OF MANUFACTURING A KETTLEBELL

(75) Inventor: Richard Zdzislaw Januszek, Peterborough (GB)

(73) Assignee: Escape Fitness Limited, Cambridgeshire (GB)

( * ) Notice: Subject to any disclaimer, the term of this patent is extended or adjusted under 35 U.S.C. 154(b) by 381 days.

(21) Appl. No.: 13/527,846

(22) Filed: Jun. 20, 2012

(65) Prior Publication Data

US 2012/0322631 A1 Dec. 20, 2012

(51) Int. Cl.
*A63B 21/072* (2006.01)
*A63B 71/00* (2006.01)

(52) U.S. Cl.
CPC ..... *A63B 21/072* (2013.01); *A63B 2071/0063* (2013.01)
USPC ..... 482/108; 482/106; 482/93

(58) Field of Classification Search
CPC ..... A63B 21/072; A63B 21/0724
USPC ..... 482/92–109
See application file for complete search history.

(56) References Cited

U.S. PATENT DOCUMENTS

| | | | | |
|---|---|---|---|---|
| 1,316,683 | A * | 9/1919 | Calvert | 482/93 |
| 6,099,443 | A | 8/2000 | Landfair | |
| 2007/0135274 | A1 | 6/2007 | Blateri | |
| 2010/0120588 | A1 | 5/2010 | Krull | |

* cited by examiner

*Primary Examiner* — Loan H Thanh
*Assistant Examiner* — Rae Fischer
(74) *Attorney, Agent, or Firm* — Ice Miller LLP

(57) ABSTRACT

A kettlebell comprising a handle and a main body portion. The handle comprising a loop handle having a grip portion and first and second arm portions extending from opposite ends of a center portion attaching the grip portion of the handle to the cast body portion. The arm portions have distal ends and the cast main body portion is cast around the distal ends of the handle arms. The main body weight portion is cast around a portion of the handle to thereby secure the handle to the cast main body portion. The body portion is cast onto the end of the handle such that the body portion is both formed and attached to the handle in a single operation thereby providing a secure connection between the main body and the handle. The body may only become detached from the handle through fracture of the handle or the body.

13 Claims, 7 Drawing Sheets

KETTLEBELL AND METHOD OF MANUFACTURING A KETTLEBELL

PRIORITY

The present application is a U.S. Nonprovisional Application and claims the priority benefit of pending UK Application No. GB 1110345.4, titled "KETTLEBELL AND METHOD OF MANUFACTURING A KETTLEBELL," filed Jun. 20, 2011, the disclosure of which is incorporated herein by reference.

The present invention relates to an exercise device for weight lifting exercises and in particular to a kettlebell and a method manufacturing the same.

Kettlebells are a well known traditional weighted exercise device commonly used in gyms and have been largely unchanged over many years. Kettlebells comprise a weighted body with a single generally loop type handle which a user grips typically with one hand to lift and raise the kettlebell and carry out a number of exercises. Kettlebells are distinct to other types of exercise devices, for example dumbbells and barbells, in that they comprise a single weight and typical loop handle. The body is typically spherical and a range of kettlebells may be provided having differing weights.

Conventionally kettlebells are cast as an integral single one piece assembly from cast iron in varying sizes and weights. Kettlebells may be partially or fully covered in for example rubber or polyurethane to provide a more attractive appearance and provide protection when the kettlebells are dropped on the floor during use. Kettlebells are cast as a one piece structure in order to provide sufficient strength and robustness to withstand use. In particular kettlebells are subject to multiple impacts and jarring as they are dropped onto the floor and variously swung around by a user. Moreover due to the weight of the kettlebells and the swing movements carried out during exercise, it is highly undesirable for them to fail and for the body portion to become detached from the handle.

While such traditional kettlebells have been widely used, it has been identified that there are problems with such cast conventional kettlebells. In particular the finish of cast iron can be poor. This detracts from the appearance of the kettlebells and in relation to the handle is particularly undesirable as a rough cast surface is not ideal for gripping by a user. Furthermore, due to the loop shape of the handle machining of the cast loop handle to improve its surface further is not practical. Providing a covering over the outer surface of the cast kettlebells can improve the appearance and surface quality.

However providing a cover in the grip region is not ideal. Indeed it has been found important to provide a handle having both a suitable shape and surface for a user to grip and hold the kettlebells. One example of such an integral kettlebells is shown for example in US 20102055960.

More recently it has been proposed to cast the main body of the kettlebells and to then weld a metal loop handle to the cast body in a subsequent operation. This however has been found to also have its problems In particular welding of the handle to the cast body is not straightforward and requires accurate fabrication of both the handle and body. In addition welding for example a stainless steel looped handle (which is the preferred material for a handle due to its resistance and surface finish obtainable) to cast iron (which is the preferred material for the cast body) is in itself problematic. Furthermore such welded connections between a handle and body introduce a weakness especially if there are any defects in the welding due to for example the problems in such welding. It has been found that such kettlebells with welded handles may in use fail which is both undesirable and potentially dangerous. A welded connection between a handle and kettlebells body may also be unsightly and adds an additional manufacturing step and increases manufacturing costs. It is also difficult to accurately align the loop handle with the body to a sufficient accuracy and stability in order to achieve a satisfactory weld and weld quality.

It has also been proposed in U.S. Pat. No. 7,883,452 for example to couple a separate handle to a kettlebells by a pivotal screw connection. This arrangement is however more complex to manufacture and assembly comprising a number of components and such a pivotal connection may be prone to weakness and failure in use.

It is therefore desirable to provide an improved kettlebell which addresses the above described problems and/or which more generally offers improvements or an alternative to existing arrangements. In particular it is desirable to provide kettlebells with an improved handle arrangement which is suitably robust while also being relatively simple and cheap to manufacture.

According to the present invention there is therefore provided a kettlebell and a method of manufacturing a kettlebell as described in the accompanying claims.

In an embodiment of the invention there is provided a kettlebell comprising a handle and a main body portion. The main body weight portion is cast around a portion of the handle to thereby secure the handle to the cast main body portion.

By casting the body portion onto the end of the handle the body portion is both formed and attached to the handle in a single operation reducing manufacturing steps and adequately attaching the handle to the body portion. This means of fixing provides a secure connection between the main body and the handle which has been found to be far superior to previous fixing methods. As the body is formed about the handle there is no requirement for additional fixing means and as such no additional components to cause failure. The body may only become detatched from the handle through fracture of the handle or the body, the likelihood of which is extremely minimal.

The handle may comprise a loop handle having a grip portion and first and second arm portions extending from opposite ends of a centre portion attaching the grip portion of the handle to the cast body portion. The arm portions may have distal ends and the cast main body portion is cast around the distal ends of the handle arms.

The arms preferably extend at an angle in relation to each other and preferably to each other thereby preventing them from being pulled out of the cast body.

The handle may include interlocking features around the cast main body is cast to interlock the handle to the cast structure.

The interlocking features preferably comprise surface features formed on the handle.

The interlocking features may comprise grooves and/or projections formed in the outer surface of the portion about which the main body is cast.

A portion of the handle about which the cast main body is cast may be enlarged at least in one dimension.

A bore may be machined within a portion of the handle around which the main body is cast. The handle may comprise a stainless steel or chrome plated handle. A stainless steel handle and/or machined surface finish provides both an attractive appearance to the kettlebell and has a surface texture and finish which can be readily and comfortably gripped and grasped by a user.

The cast main body may be cast from cast iron.

The kettlebell may further comprise an outer cover around the outside of the at least the cast main body portion.

The coating may comprise a polyurethane or rubber material.

The portion of the handle around which the main body is cast preferably extends at an angle to the direction of load on the handle when in use.

A portion of the handle about which the main body is cast may be bent and preferably curved along at least a portion of its length.

In another embodiment of the invention there is provided a method of manufacturing a kettlebell comprising forming a handle; providing a mold having a first recess for receiving a portion of the handle and a second recess connected to the first recess for forming a main body portion of the kettlebell; locating the handle within the first recess of the mold with a portion of the handle extending and located in the second recess; casting the main body portion of the kettlebell within the second recess and around the portion of the handle located within the second recess; removing the handle and cast main body from the mold.

The mold preferably comprises a resin impregnated sand mold.

The method may further comprise covering the main body portion with a resilient cover.

The method may further comprise molding a resilient cover onto the main body portion.

The present invention will now be described by way of example only with reference to the following figures in which.

Figure 1:
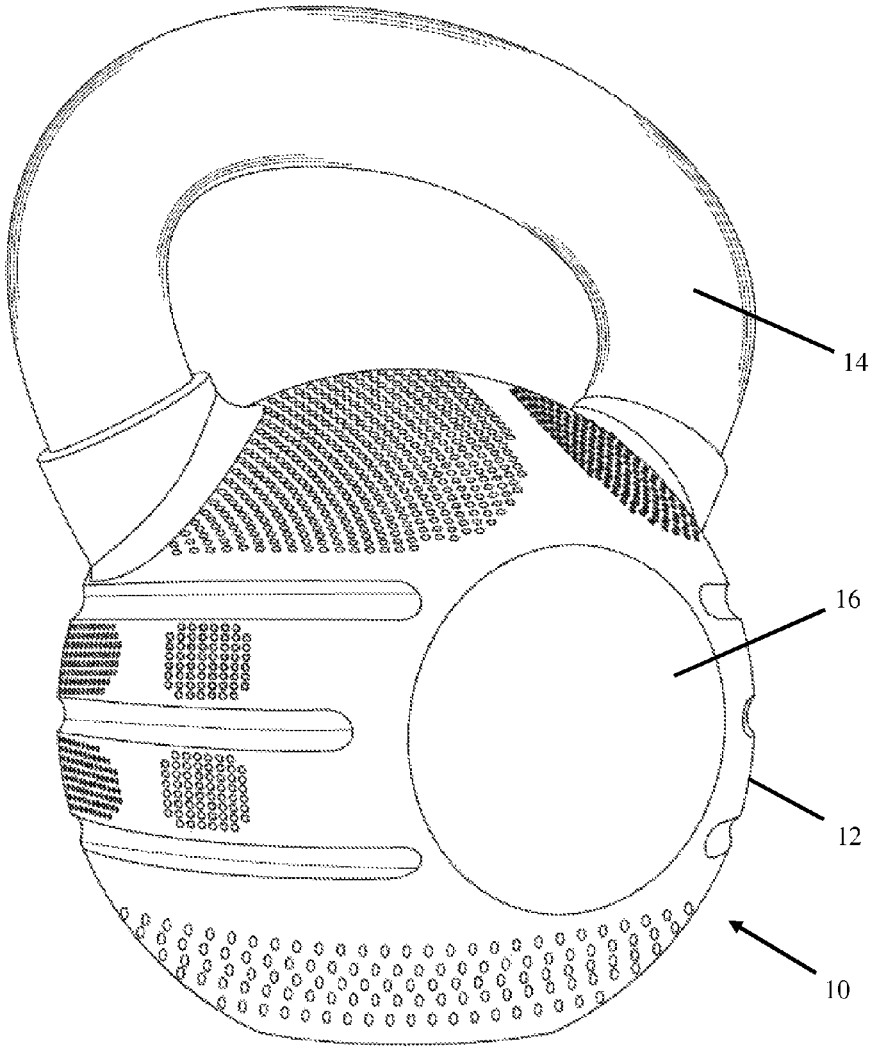
FIG. 1 is a schematic illustration of a kettlebell in accordance with the present invention.

Referring to FIG. 1 there is shown a kettlebell 10 in accordance with the invention. The kettlebell 10 comprises a generally spherical main body portion 12 connected (as discussed further below) to a loop handle 14. The main body portion 12 is further covered with a polyurethane or rubber outer coating 16 to protect the main body 12 and also prevent the kettlebell 10 from damaging other objects. While the main body portion 12 is in this example generally spherical as is traditional for kettlebells it will be appreciated that the main body portion may have a different shape.

The loop handle 14 comprises a separate component and element of the kettlebell 10, the handle 14 preferably comprises a stainless steel rod or chrome plated metal handle which is machined to provide and have a smooth outer surface and which is bent into a loop or formed shape. The handle 14 preferably includes a relatively straight centre section 13 which is sized such that it can be readily and easily grabbed by a user. A pair of curved arm sections 15 which are curved towards each other extend from either end of the straight section 13. A stainless steel handle 14 and machined surface finish provides both an attractive appearance to the kettlebell 10 and has a surface texture and finish which can be readily and comfortably gripped and grasped by a user. Furthermore stainless steel is also generally resistant to corrosion and in particularly less affected by sweat from the users hand which could use deterioration if steel or some other materials could be used. The machined surface also provides a relatively smooth surface.

The main body portion 12 comprises a body of cast iron which, in accordance with the invention is cast around and onto the distal ends 18, 20 of the handle 14. The main body portion is sized and shaped so as to produce a kettlebell 10 including the handle 14 of the appropriate desired weight. More specifically and to manufacture the kettlebell 10 the manufactured handle 14 is placed within a mold with the distal end 18, 20 of the handle 14 into a recess defined in the mold responding to the desired shape and size of the body portion 12. Molten cast iron, or other material, is then poured into the mold and in particular recess and around the distal ends 18, 20 of the handle 14 to thereby both inform the body portion 12 around the distal ends 18, 20 of the handle portion and secure the handle 14 to the body portion 12. The cast iron in particular both attaches to the distal ends 18, 20 of the handle 14 to secure the handle to the body structure. In addition the shape of the arm portions 15 of the handle 14 and in particular the inwardly curving arrangement and convergence of the distal ends 20 secure the handle 14 to the cast body 12 with the ends 18, 20 of the arm portions 15 of the handle 14 being prevented from being pulled out of the cast body portion 12 due to the inwardly curving nature of the arms 13. As a result the handle 14 is securely attached to the body portion 12. By casting the body portion 12 onto the end of the handle 14 the body portion 12 is both formed and attached to the handle in a single operation reducing manufacturing steps and adequately attaching the handle to the body portion 12.

The ends 18, 20 of the handle 14 in particular extend at an angle with respect to each other and preferably at an angle to the direction of load which is generally vertical upon the handle 14 to thereby secure the handle 14 to the cast main body 12. While the handle 14 is preferably a loop type handle, in other embodiments one may comprise only one main portion extending from the grip portion.

The mold for the cast iron main weight body portion 12 and kettlebell 10 preferably comprises a sand mold. The mold must however have sufficient strength when formed to support and locate the heavy stainless steel handle 14 in position during the casting of the body portion 12. Accordingly it is preferred that a resin impregnated and reinforced sand mold and technique is used to form the mold. Such resin impregnated sand molds are relatively recent but well known and provide a relatively robust and sound cast mold for use in casting as compared to traditional sand molds. In particular simple sand cast molds would generally not have sufficient strength in order to securely and accurately locate the handle 14 in position. A more recent impregnated sand molds have sufficient strength to support the handle 14 during casting. Since such molding techniques are however known they will not be described further.

It will be appreciated that conventionally incorporating the handle 14 accurately into the mold during casting would not have been contemplated since, particularly due to its weight, it would have been anticipated that the handle 14 would move during assembly of the sand mold and casting. Furthermore conventionally kettlebells have been formed integrally as a one piece cast structure and this is the established general teaching.

The outer covering 16 in particular preferably covers the main weight body portion 12 and also interface between the handle and main weight body portion 12 to provide a more pleasing appearance to the dumbbell covering the rough cast surface of the body portion 12 and interface. In addition the covering also protects the cast body portion 12 from the element and accordingly corrosion as well as protecting both the kettlebell 10 from damage as well as due to the resilience of the outer covering protecting the other objects from damage by the kettlebell 10. The covering 16 preferably does not however extend over the main part of the handle 14. Such users prefer to grip a solid metal handle the coating 16 preferably comprises molded polyurethane or rubber or other suitable material which is molded around and onto the body portion 12 and kettlebell 10. Molding and addition of such resilient coatings 16 onto a kettlebell is well known and will therefore not be described further.

Figure 2:
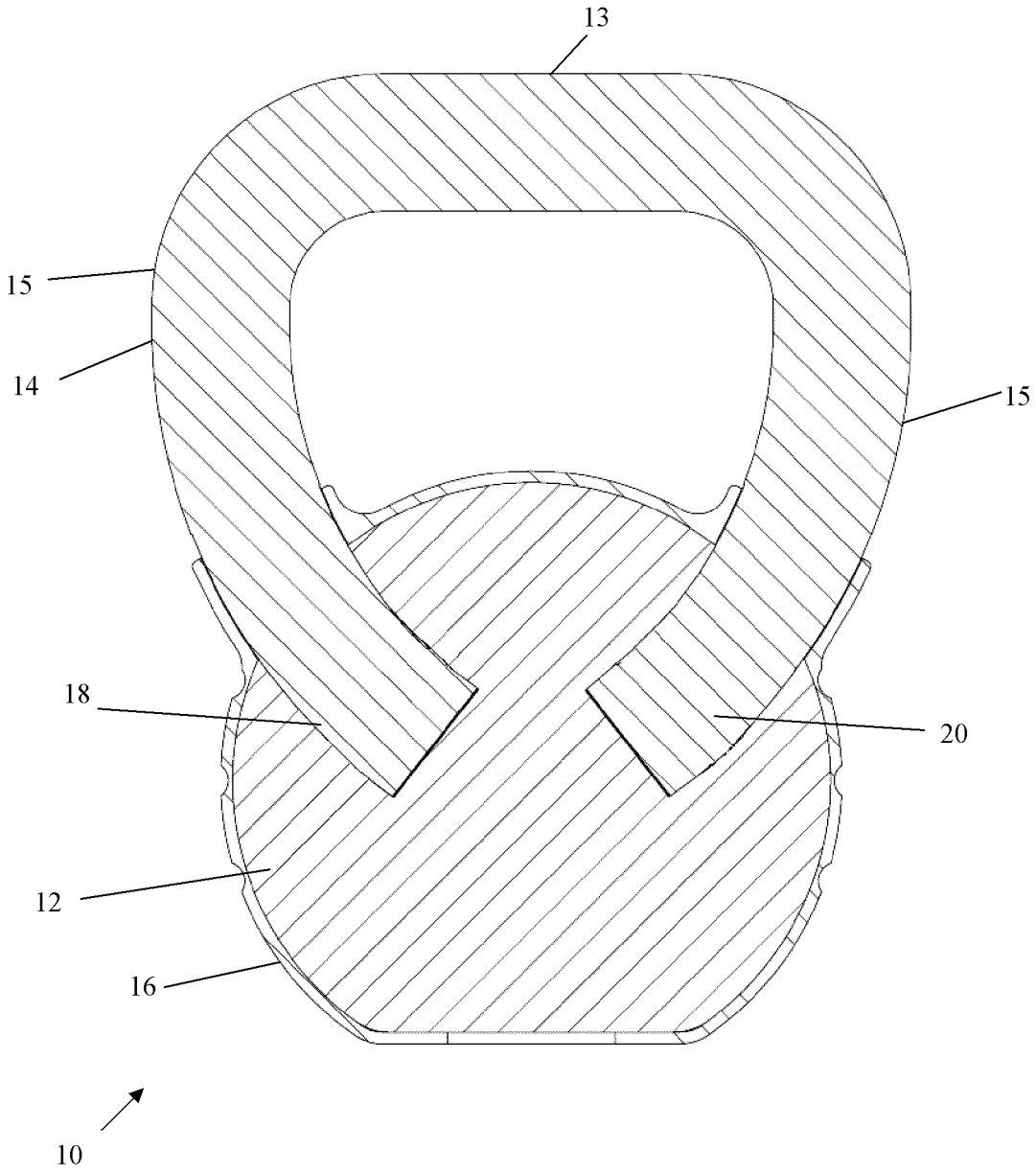
FIG. 2 is a schematic vertical cross section of the kettlebell shown in FIG. 1 showing the kettlebell in accordance with an embodiment of the invention.
Figure 3:
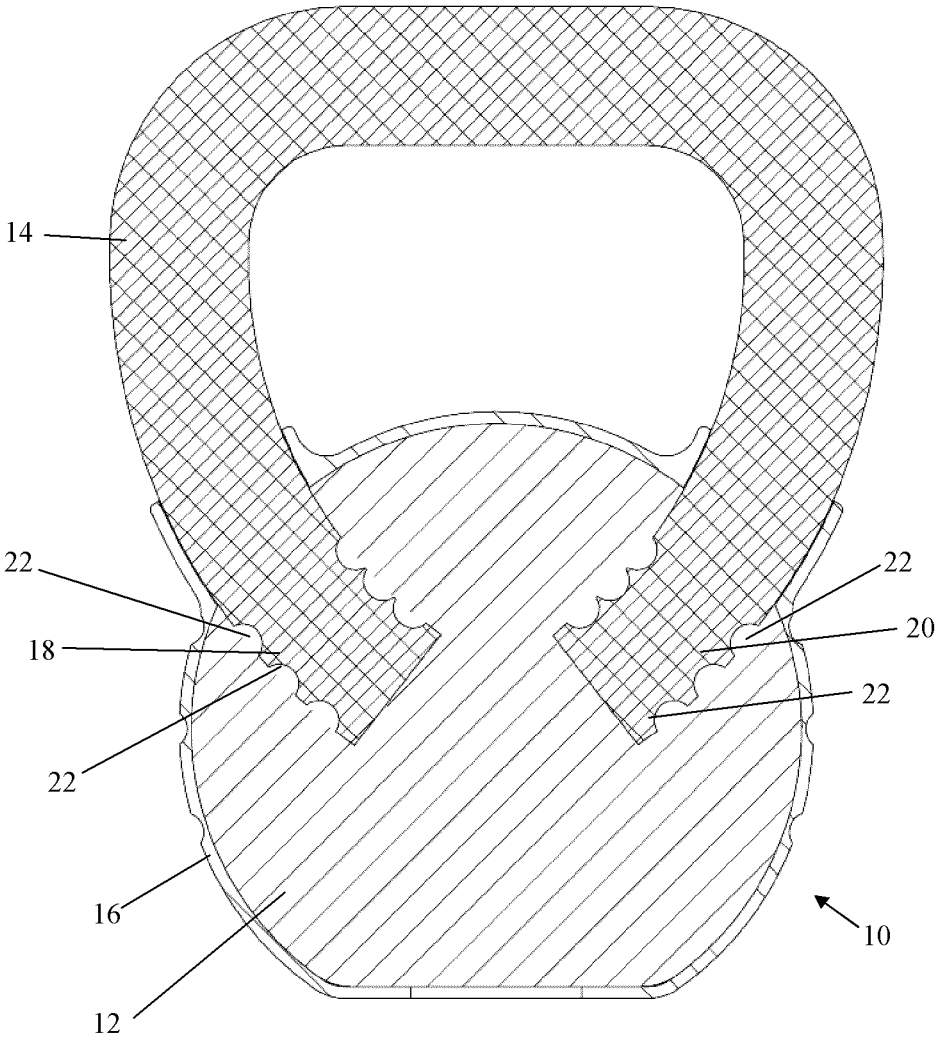
FIG. 3 is a vertical cross section similar to FIG. 2 through kettlebell in accordance with a second embodiment of the invention.

Referring to FIG. 3, in an alternative embodiment generally similar to that described in relation to FIGS. 1 and 2 and with like reference numerals for like features, at least one and preferably a plurality of grooves 22 are formed around the outer surface of the distal end portions 18, 20 of the handle 14. The grooves 22 provide an improved key to interlock with the cast body portion 12 formed around the ends 18, 20 of the handle 14 with the cast material flowing into the grooves 22 further securing the handle 14 to the cast body portion 12. The grooves may comprise circumferential grooves 22 around the distal ends 18, 20 of the handle 14 or may have any other configuration or shape.

Figure 4:
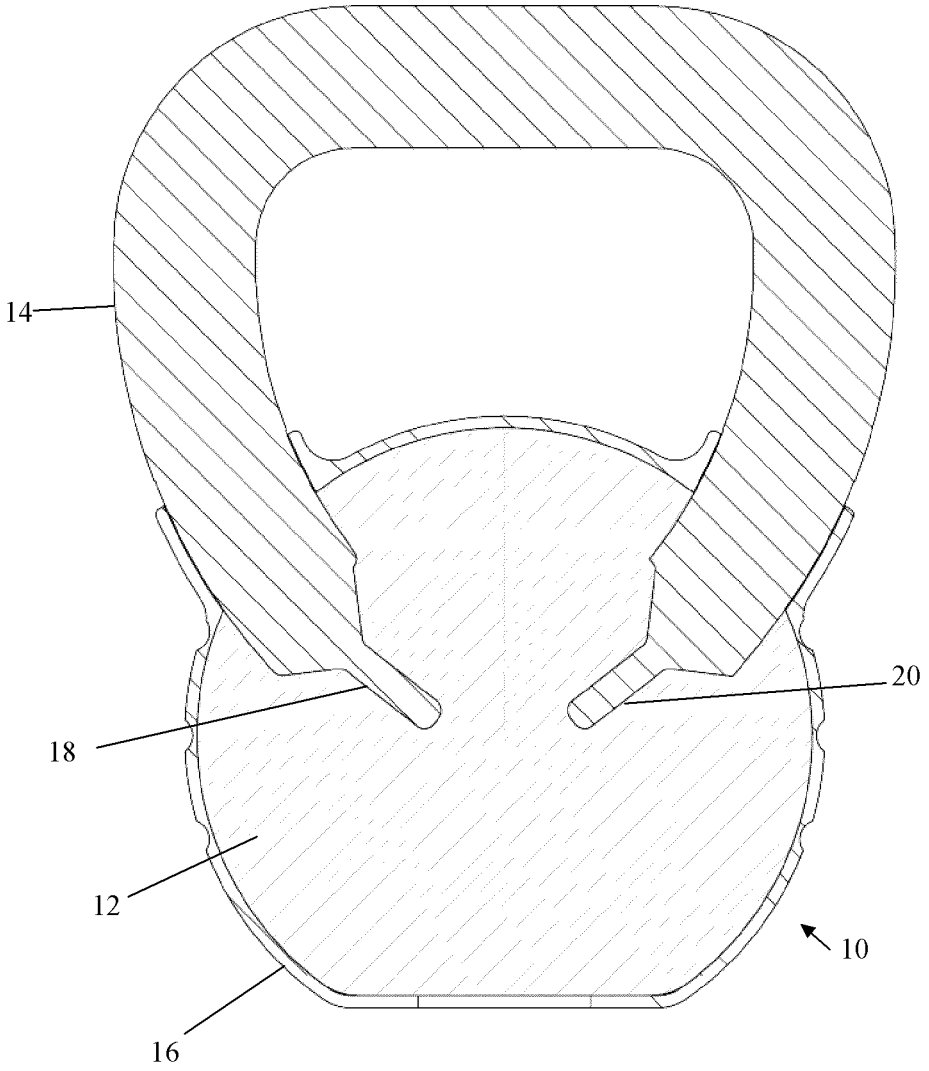
FIG. 4 is a vertical cross section through a kettlebell of a third embodiment of the invention.
Figure 5A:
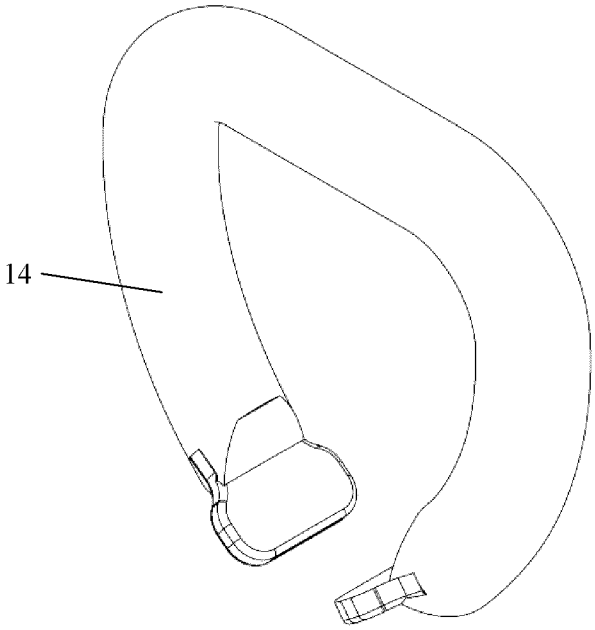
FIGS. 5A and 5B are schematic perspective and front views of the handle of the kettlebell shown in FIG. 4.
Figure 5B:
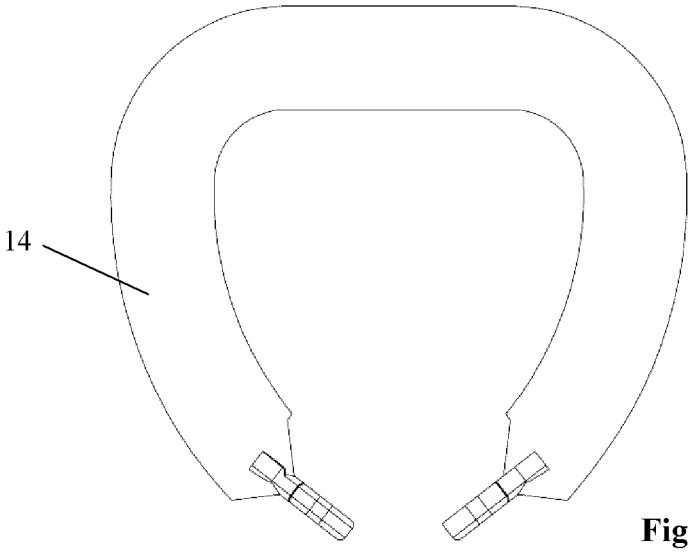

Another alternative embodiment is shown in FIGS. 4 and 5A and 5B. This is again generally similar to the previous embodiments and again like reference numerals are used for like features. In this embodiment the distal ends 18, 20 of the handle 14 are shaped and formed so as to further interlock with the cast body portion 12 formed around them. In particular as shown in FIGS. 5A and 5B showing the handle 14 on its own the distal ends 18, 20 of the handle 14 are formed such that they are widened and splayed in at least one direction such that when the body portion 12 is cast around the distal ends 18, 20, these enlarged portions are retained in the structure. In particular in this case the distal ends 18, 20 are flattened for example by suitable forging such that the ends extend laterally wider than the width of the remaining portion of the handle 14.

It will be appreciated that the distal end 18, 20 can be enlarged and formed in other ways to provide different shaped distal ends 18, 20 having dimensions in at least one direction to thereby interlock with the cast body portion 12.

Figure 6:
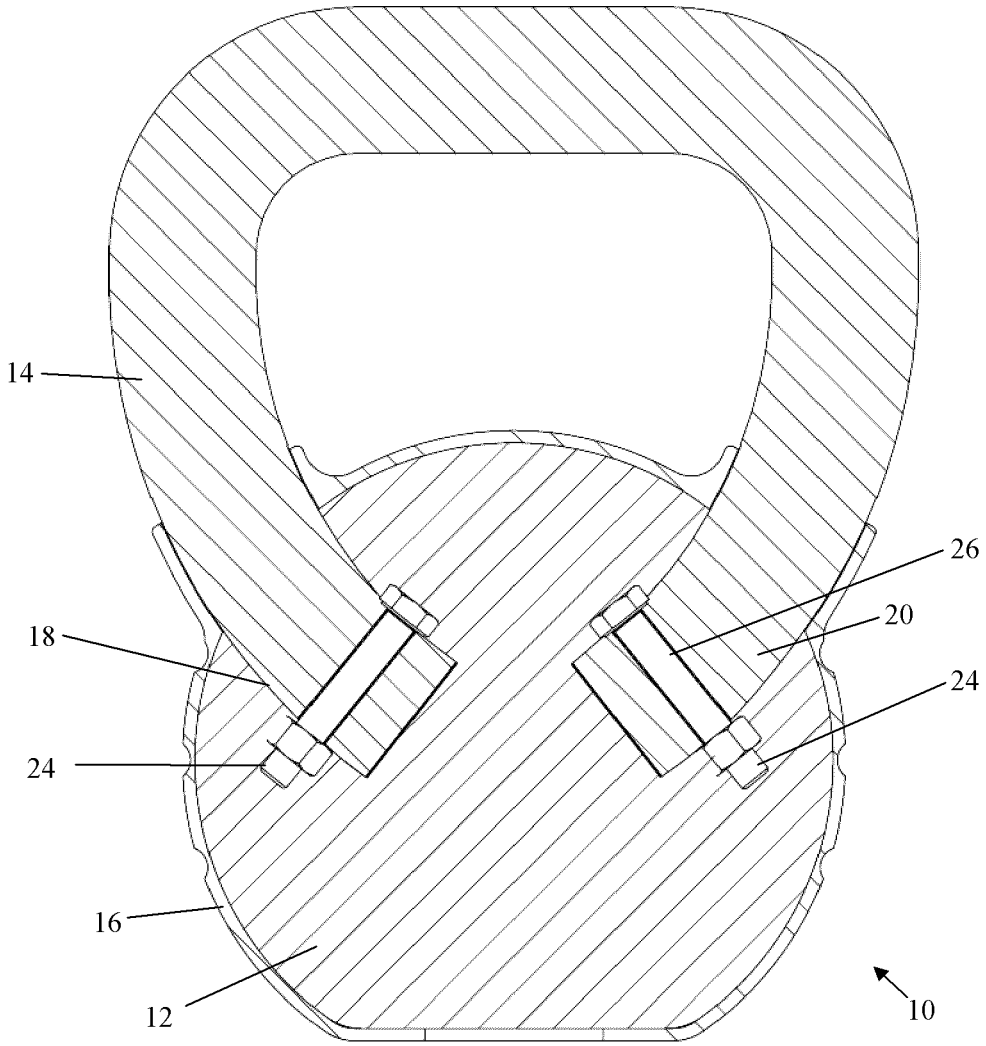
FIG. 6 is a vertical cross section similar to that of FIG. 2 through a kettlebell in accordance with an alternative embodiment of the invention.

FIG. 6 shows a yet further variation and embodiment of the invention again similar to the previous embodiment with like reference numerals used for corresponding features. In this embodiment bolts 24 are fitted into bores 26 formed in the distal ends 18, 20 of the handle 14 prior to casting of the body portion 12 about the ends 18, 20 of the handle 14. The bolts 24 project from the ends 18, 20 of the handle 14 thereby enlarging the ends 18, 20 of the handle 14 and further interlocking the handle 14 with the cast main body 12 which is cast around the ends 18, 20 of the handle 14 and bolts 24. In an alternative variation the bolts 24 may be omitted and bores 26 simply provided in and extend through the ends of the handle 14 into which the cast material of the cast body portion 12 will flow during casting to interlock the handle 14 with the cast portion 12.

Figure 7:
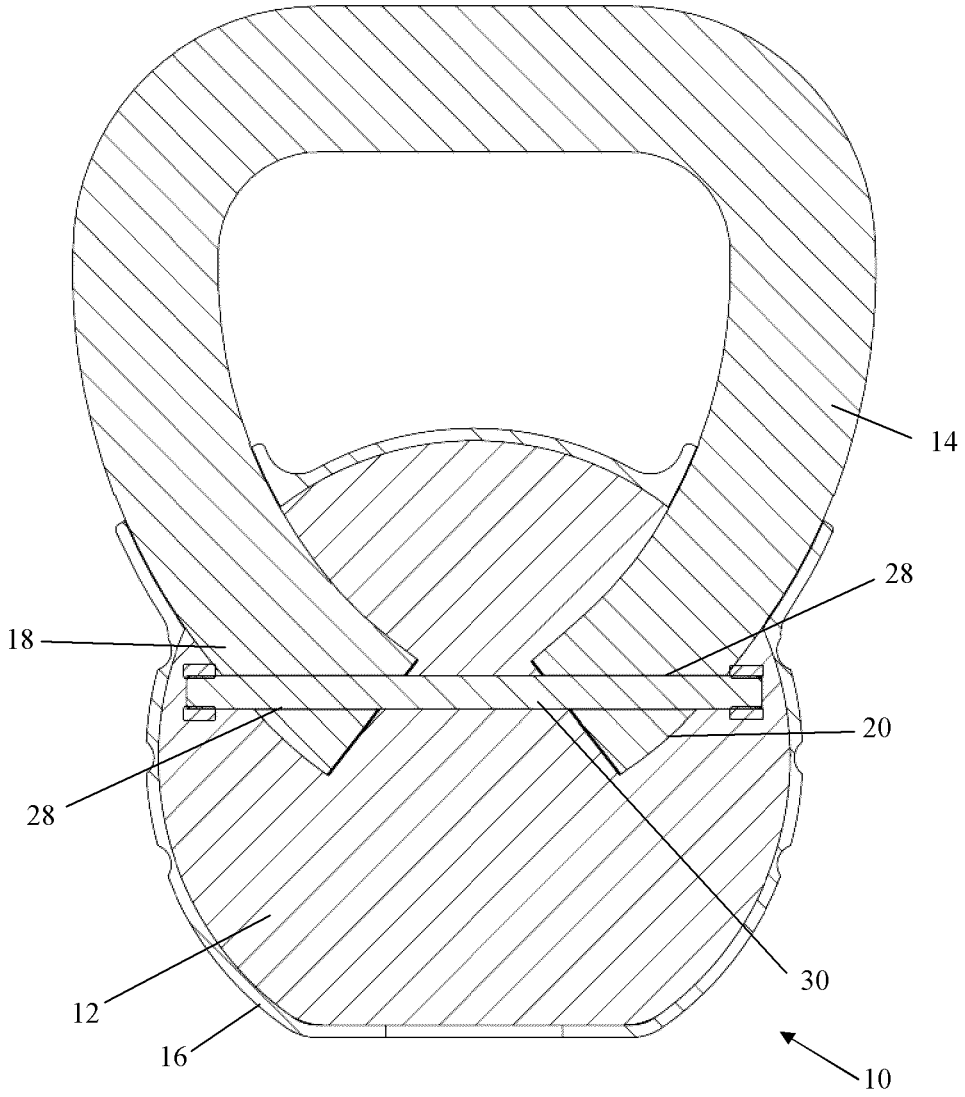
FIG. 7 is a vertical cross section similar to that of FIG. 2 of a kettlebell in accordance with a yet further embodiment of the invention.

FIG. 7 shows another alternative embodiment of the invention similar to the previous embodiments with again like reference numerals used for corresponding features. In this embodiment a tie bar 30 is fitted into bores 28 machined in the distal ends 18, 20 of the handle 14 which extends between and interconnects the distal ends 18, 20 of the handle 14. The tie bar 13 is fitted to the handle 14 prior to casting of the main body portion 12 with the cast main body portion 12 extending around the tie bar and thereby interlocking and securing the tie bar and handle within the cast main body 12. In a further variation on this embodiment the handle 14 itself may comprise a complete loop with the distal end 18, 20 being joined together and abutting each other.

In all these embodiments the handle 14 is secured to the cast main body 12 by virtue of the shape of the end 18, 20 and configuration of the handle 14 such that the handle 14 can not be removed and detached from the cast 12 and is mechanically secured thereto in addition to the cast material of the cast main body 12 adhering directly to the handle 14. The mechanical interference of the handle with the cast main body 12 however provides a much stronger and secure attachment of the handle to the cast main body than for example is provided by simple adherence of the material to the metal of the handle 14 for welding. Furthermore by casting the main body 12 around the ends 20 of the handle 14 the connection between the handle 14 and main body 12 is hidden within the main body 12 providing a more aesthetically pleasing kettlebell 10.

It will be appreciated that various further modification and variations to the kettlebell arrangement described and alternative embodiments may be provided. In particular while it is preferable to use a stainless steel handle 14 other materials may be used. Similarly whilst cast iron is the preferred material for the cast main body 12 in particular due to its density, weight and relative cheapness and ease of casting other materials may be used for the main body. In addition various alternative interlocking arrangements and formations in particular on the distal ends 18 and 20 of the handle 14 may be utilised to enhance the interlocking and interconnection between the handle and body 12. In other embodiments the outer coating 16 may be omitted.

The principle and mode of operation of this invention have been explained and illustrated in its preferred embodiment. However, it must be understood that this invention may be practiced otherwise than as specifically explained and illustrated without departing from its scope as defined by the claims.

What is claimed is:

1. A kettle bell comprising a separate handle and a main body weight portion, wherein the main body weight portion is cast around a portion of the handle to thereby secure the handle to the cast main body portion, and wherein the handle has a grip portion and first and second arm portions extending from opposite ends of a center portion attaching the grip portion of the handle to the cast body portion, wherein the arm portions have distal ends and the cast main body portion is cast around the distal ends of the handle arms.

2. A kettlebell as claimed in claim 1 wherein the arms extend at an angle in relation to each other and preferably to each other.

3. A kettlebell as claimed in claim 1 wherein the handle includes interlocking features around the cast main body is cast to interlock the handle to the cast structure.

4. A kettlebell as claimed in claim 3 wherein the interlocking features comprise surface features formed on the handle.

5. A kettlebell as claimed in claim 3 wherein the interlocking features comprise grooves and/or projections formed in the outer surface of the portion about which the main body is cast.

6. A kettlebell as claimed in claim 1 wherein a portion of the handle about which the cast main body is cast is enlarged at least in one dimension.

7. A kettlebell as claimed in claim 1 wherein a bore is machined within a portion of the handle around which the main body is cast.

8. A kettlebell as claimed in claim 1 wherein the handle comprises a stainless steel or chrome plated handle.

9. A kettlebell as claimed in claim 1 wherein the cast main body is cast from cast iron.

10. A kettlebell as claimed in claim 1 further comprising an outer cover around the outside of the at least the cast main body portion.

11. A kettlebell as claimed in claim 10 wherein outer cover comprises a polyurethane or rubber material.

12. A kettlebell as claimed in claim 1 wherein the portion of the handle around which the main body is cast extends at an angle to the direction of load on the handle when in use.

13. A kettlebell as claimed in claim 1 wherein a portion of the handle about which the main body is cast is bent and preferably curved along at least a portion of its length.

* * * * *